United States Patent [19]

De Yarman

[11] 4,119,283

[45] Oct. 10, 1978

[54] KITE STRUCTURE

[76] Inventor: James E. De Yarman, 2943 N. Dousman St., Milwaukee, Wis. 53212

[21] Appl. No.: 751,723

[22] Filed: Dec. 17, 1976

[51] Int. Cl.[2] ..... B64C 31/06

[52] U.S. Cl. ..... 244/153 A; 46/76 R; 46/79; 403/347

[58] Field of Search ..... 244/153 R-155 A; 46/74 R, 77, 74 A, 76 R, 76 A, 79, ; 403/354, 375, 664, 241, 347

[56] References Cited

U.S. PATENT DOCUMENTS

| | | | |
|---|---|---|---|
| D. 162,707 | 4/1951 | Benson | 46/79 X |
| 606,622 | 6/1898 | Cooley | 244/154 |
| 2,714,783 | 8/1955 | Walker | 46/77 |
| 2,744,702 | 5/1956 | Briggs | 244/154 |
| 2,896,370 | 7/1959 | Witt, Jr. | 46/79 |
| 3,966,337 | 6/1976 | Crawford | 403/347 X |

FOREIGN PATENT DOCUMENTS

| | | | |
|---|---|---|---|
| 396,274 | 5/1923 | Fed. Rep. of Germany | 46/79 |
| 440,789 | 7/1912 | France | 244/154 |
| 9,238 of | 1899 | United Kingdom | 244/154 |

*Primary Examiner*—Galen L. Barefoot

*Attorney, Agent, or Firm*—Andrus, Sceales, Starke & Sawall

[57] ABSTRACT

The kite structure of this invention comprises a pair of plates assembled together in normal intersecting relation. The plates are provided with grooves and slots which are engaged during assembly. The plates may be shaped to provide numerous different three dimensional configurations.

1 Claim, 13 Drawing Figures

Fig. 1
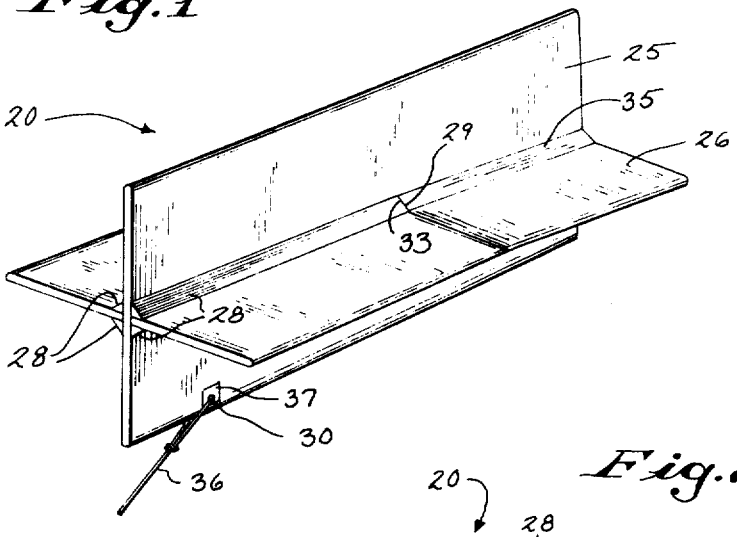
Fig. 2
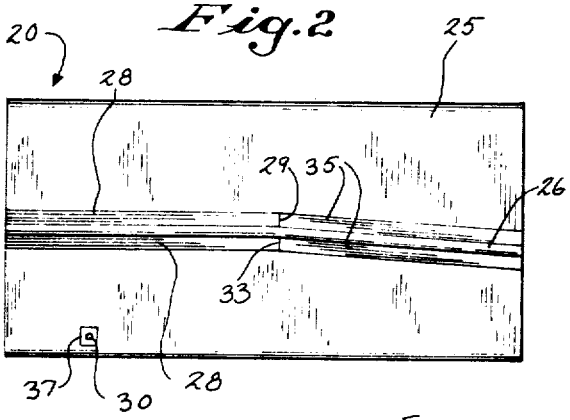
Fig. 3
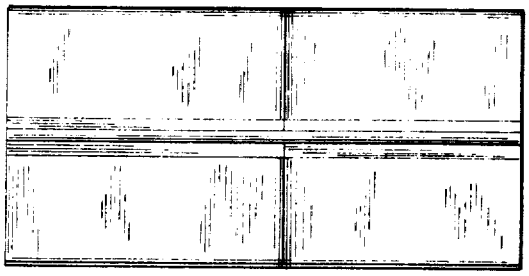
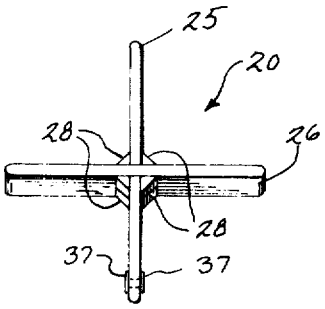
Fig. 4
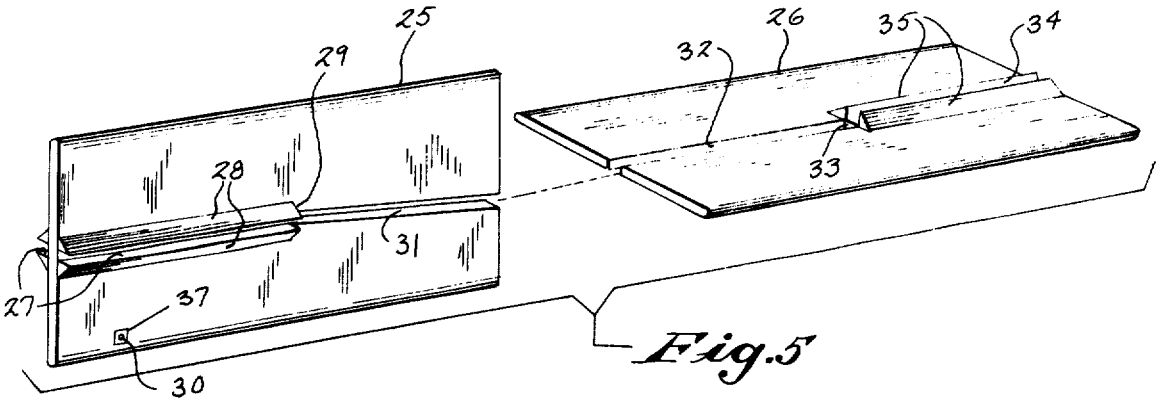
Fig. 5

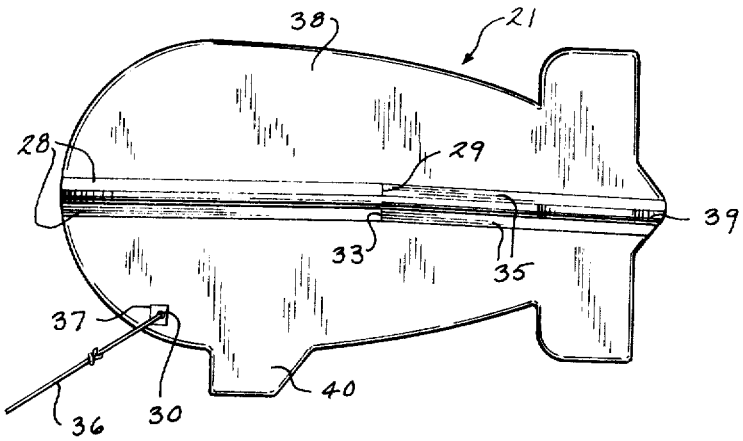
Fig. 6
Fig. 7
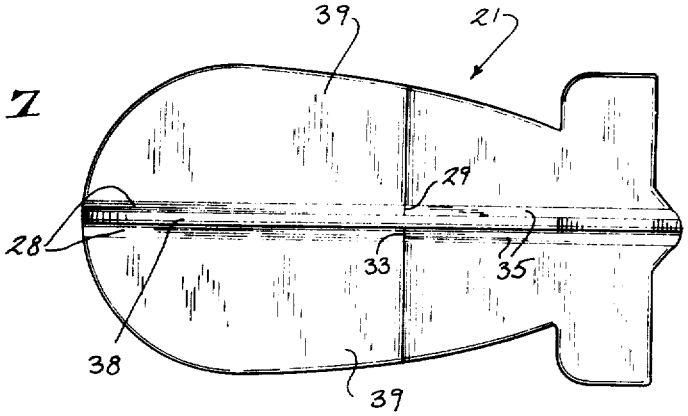
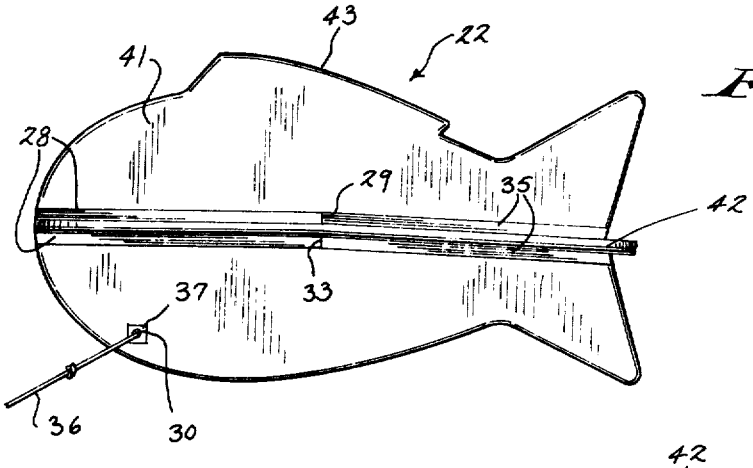
Fig. 8
Fig. 9
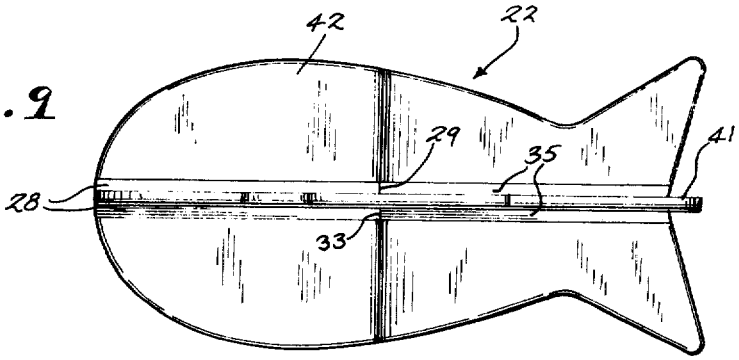

KITE STRUCTURE

NATURE AND SUMMARY OF THE INVENTION

This invention relates to kites and more particularly to kites that can be fabricated to have any one of numerous configurations, and are easily assembled, and can be flown without a tail per se.

Generally, a kite according to this invention comprises a vertical plate and a transverse plate assembled together in intersecting relation. More specifically the forward portion of one of the plates is provided with first grooves along the longitudinal centerline on both sides thereof and the rear portion of the plate is provided with a first slot that opens rearwardly of the plate with the forward end of the first slot being aligned with the first grooves. The rearward portion of the other of the plates is provided with second grooves along the longitudinal centerline on both sides thereof and the forward portion of the other of the plates is provided with a second slot that opens forwardly of the plate with the rear end of the second slot being aligned with the second grooves. In the assembly of the plates, the first grooves receive the edge portions of the second slot and the second grooves receive the edge portions of the first slot to place the plates in normal intersecting relation.

DESCRIPTION OF THE DRAWING FIGURES

The drawings furnished herewith illustrate the best mode presently contemplated for the invention and are described hereinafter.

In the drawings:

FIG. 1 is a perspective view of a kite of this invention;

FIG. 2 is a side elevational view of the kite of FIG. 1;

FIG. 3 is a plan view of the kite of FIG. 1;

FIG. 4 is an end view of the assembled plates forming the kite of FIG. 1;

FIG. 5 is an exploded perspective view generally suggesting the mode of assembly for the plates forming the kite of FIG. 1;

FIG. 6 is a side elevational view for a kite formed of plates suggestive of a blimp configuration;

FIG. 7 is a plan view of the kite of FIG. 6;

FIG. 8 is a side elevational view of a kite formed of plates and suggestive of a fish configuration;

FIG. 9 is a plan view of the kite of FIG. 8;

DESCRIPTION OF THE ILLUSTRATED EMBODIMENTS

Figure 10:
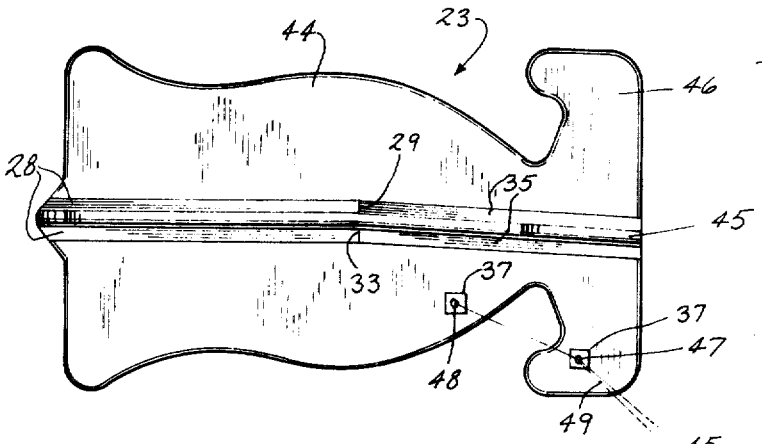
FIG. 10 is a side elevational view of a kite formed of plates suggestive of a bell configuration.

Referring to the drawings, the several kites 20–24 of FIGS. 1, 6, 8, 10 and 12, respectively, generally comprise a pair of plates which are assembled in normal intersecting relation to each other.

In the embodiment of FIGS. 1–5, the vertical plate 25 and the transverse plate 26 are generally rectangular and of equal size having a length dimension generally double that of the width. Plates 25 and 26 are preferably fabricated from a molded expanded pellet polystyrene in view of its relative light weight and strength characteristics. The plates are preferably 3/8" thick, but some variation from that dimension is probably acceptable. All outside edges of the plates 25 and 26 are rounded for appearance and to eliminate the otherwise sharp edges which are generally more prone to chipping.

The vertical plate 25 is provided with a groove 27 generally symmetrical with respect to the longitudinal centerline thereof on opposite sides of the plate. The opposed grooves 27 have a width generally corresponding to the thickness of the plate material and are formed between generally parallel fillets 28. Fillets 28 may be generally triangular, as shown, and may be formed integrally with the plate or glued or otherwise secured onto the sides of the plate 25. Groove 27 are adapted to receive the thickness of the plate material with a sliding press fit.

The fillets 28 forming the grooves 27 extend generally from the front end of plate 25 to a location at 29 somewhat beyond the midpoint of the plate as will be further described hereinafter. The fillets 28 further serve to reinforce the forward portion of plate 25 which is provided with the eye 30 beneath the centerline for tethering the kite 20.

The vertical plate 25 is provided with a slot 31 which extends rearwardly from the terminus 29 of the grooves 27 and opens to the rear end of the plate. The width of slot 31 generally corresponds to that of the grooves 27 and the forward end of the slot is in alignment with the grooves. The slot 31 may be disposed generally symmetrical with respect to the longitudinal centerline of plate 25, but a downward slope for the slot from the grooves 27, as shown, is desirable for reasons to be explained hereinafter.

The transverse plate 26 is provided with a slot 32 which is generally symmetrical with respect to the longitudinal centerline of the plate and opens forwardly. The slot 32 extends rearwardly to the location at 33 on plate 26 to provide a length corresponding to that for the grooves 27 of the vertical plate 25. From the rear terminus of slot 32 at 33 and in alignment with the slot, the plate 26 is provided with grooves 34 on opposite sides thereof. The opposed grooves 34 are formed between spaced fillets 35 and extend to the rear end of plate 26 generally symmetrical with respect to the longitudinal centerline of the plate. The width of slot 32 and grooves 34 of the transverse plate 26 correspond to the width of the slot 31 and grooves 27 of the vertical plate 25.

For assembly into a kite 20, the plates 25 and 26 are disposed in the relation as generally shown in FIG. 5 and then brought together so that the open ends of the respective slots 31 and 32 receive the opposed plates. In the process of assembly, the edge portions of slot 32 of transverse plate 26 will make initial engagement with the end portions of grooves 27 of vertical plate 25 before the edge portions of slot 31 initially engage with the grooves 34 because the slot 32 and corresponding grooves 27 are of greater length. However, the lengths of the respective slots and their corresponding grooves could be reversed if desired. The object here is to avoid having slots and corresponding grooves of equal length which will give rise to some difficulty in making simultaneous initial engagements for both sets of slots and grooves. The assembly of plates 25 and 26 is complete when the edge portions of slot 32 are fully engaged in the grooves 27 and the edge portions of slot 31 are fully engaged in the grooves 34 such that the respective locations at 29 and 33 as well as the corresponding ends of the plates are brought into coincidence as generally shown in FIGS. 1-3.

The slope downwardly and rearwardly for the slot 31 of plate 25 may be of the order of one-half inch per foot. Such a slope will enhance the press fit of the plate 26 in the grooves 27 of plate 25. The slope will also impart a downward concavity or bend to the plate 26 such that the transverse plate assumes a sort of airfoil contour during assembly to enhance the flight characteristics of the kite.

The kite 20 is tethered by the string 36 which extends through the eye or hole 30 provided in the vertical plate 25. The eye or hole 30 is desirably disposed on a line extending downwardly from the centerline intersection with the front of the kite 20 at a bridle angle of about 53½° from the longitudinal centerline and 1½ inches above the lower edge of plate 25. While the eye or hole 30 can be disposed up to perhaps an inch farther inwardly from the lower edge of plate 25 and/or on a bridle angle varying perhaps several degrees either way without materially affecting the flight characteristics of the kite 20, greater variations will likely result in a stall condition long before the kite reaches its altitude potential. A thin piece of cardboard or even masking tape 37 may be employed on both sides of plate 25 for reinforcement around the eye or hole 30 and to better distribute the stress imposed by the string 36.

Figure 11:
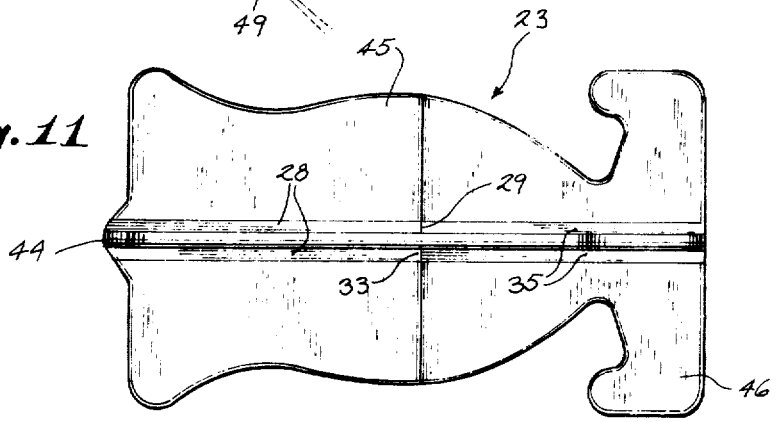
FIG. 11 is a plan view of the kite of FIG. 10.
Figure 12:
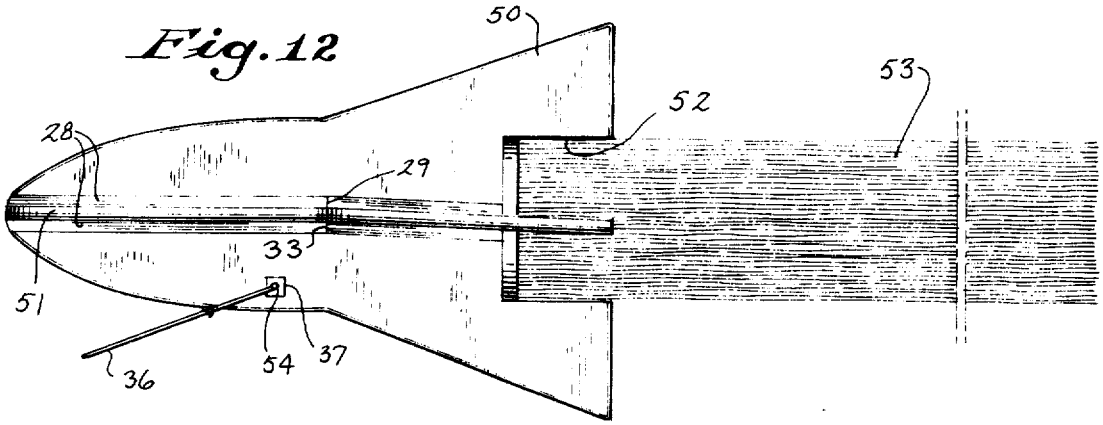
FIG. 12 is a side elevational view of a kite formed of plates and suggestive of a rocket configuration.
Figure 13:
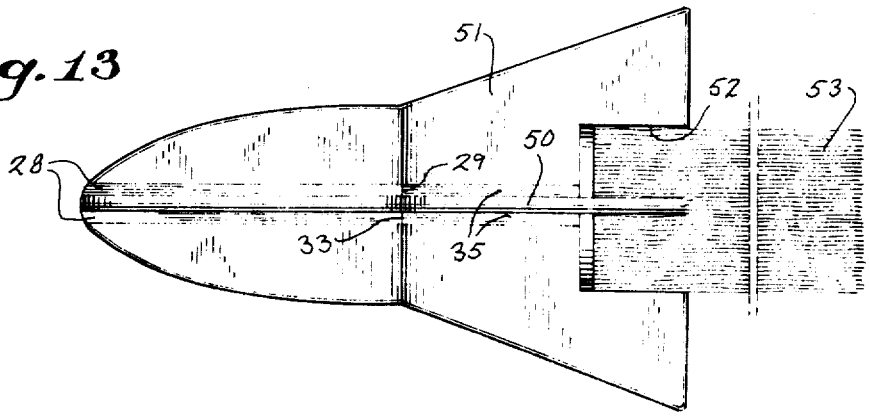
FIG. 13 is a plan view of the kite of FIG. 12.

According to FIGS. 6–11, the kite of this invention may assume any one of numerous shapes or configurations. The kite 21 of FIGS. 6 and 7 is illustrative of a blimp configuration. A fish configuration kite 22 is illustrated in FIGS. 8 and 9. FIGS. 10 and 11 show a bell configuration kite 23 and FIGS. 12 and 13 show a rocket configuration kite 24.

In the blimp configuration kite 21, the vertical plate 38 and transverse plate 39 can be generally similar in outline, as shown, except that the vertical plate includes a car projection 40 along its lower edge.

In the fish configuration kite 22, the vertical plate 41 and the transverse plate 42 are also generally similar in outline except that the vertical plate includes a dorsal fin projection 43 along its upper edge.

In both the blimp configuration kite 21 and the fish configuration kite 22, the length dimension of the several plates is generally double that of the width, similar to the kite 20 of FIG. 1. As a consequence, the bridle angle for the kites 21 and 22 will be generally similar to that for kite 20 varying only slightly to accommodate the change in shape and/or weight balance fore-and-aft. The blimp configuration kite 21, the fish configuration kite 22 as well as the rectangular plate kite 20 ordinarily require no tail to reach their altitude potential.

The bell configuration kite 23 of FIG. 10 generally comprises the normally disposed plates 44 and 45 having generally identical outlines and a length twice that of the width. The configuration for kite 23 includes the beam support 46 for the bell from which end the kite is tethered. The projections for the beam support 46 are small and too weak for bridling as previously described so that a variation is necessary. While the main eye or hole 47 for tethering is in the lower projection of the beam support 46 of the vertical plate 44, a second eye or hole 48 is provided in the bell portion of the vertical plate so that the bridle line 49 connects the spaced eyes or holes and thus provides for the distribution of the stress imposed by the bridle. The bell configuration kite 23 requires no tail.

The normally disposed plates 50 and 51 for the rocket configuration kite 24 of FIG. 11 also have generally identical outlines. The rocket configuration involving a relatively narrow nose portion and a relatively wide fin portion as shown requires substantial variation from the length and width ratio previously described. The plates 50 and 51 are each provided with a recess 52 at the rear thereof to simulate an exhaust outlet. Plastic or crepe paper tail streamers 53 are glued or otherwise secured along the forward end of recesses 52 and extend rearwardly to simulate the exhaust associated with rocket flight. The relatively wide fins and exhaust streamers 53 provide a substantial weight unbalance fore-and-aft for the rocket configuration kite 24 to require a further variation from the described mode for bridling the kite 20. The eye or hole 54 for tethering the rocket configuration kite 24 is provided in the nose portion of the lower part of the vertical plate 50 at a relatively shallow bridle angle and near to the juncture with the fin portion of the plate so that the kite can attain its desired altitude potential.

Various modes of carrying out the invention are contemplated as being within the scope of the following claims particularly pointing out and distinctly claiming the subject matter which is regarded as the invention.

I claim:

1. A kite structure, comprising a vertical plate and a transverse plate, the forward portion of said vertical plate being provided with first grooves along the longitudinal centerline on both sides thereof and the rear portion of said vertical plate having a first slot that opens rearwardly of the plate, the forward end of said first slot being aligned with the first grooves of said plate, and the rearward portion of said transverse plate being provided with second grooves along the longitudinal centerline on both sides thereof and the forward portion of said transverse plate having a second slot that opens forwardly of the plate, the rear end of said second slot being aligned with the second grooves of said plate, said plates being assembled together with the first grooves of the vertical plate receiving the edge portions of the second slot of the transverse plate and the second grooves of the transverse plate receiving the edge portions of the first slot of the vertical plate, said first slot sloping downwardly and rearwardly in the vertical plate to enhance the press fit of the edge portions of the respective slots in the corresponding grooves during assembly and to impart a downward concavity in the transverse plate so that the latter assumes a sort of airfoil contour to enhance the flight characteristics of the kite structure, and said plates being self-supporting without need for separate and/or additional framing.

* * * * *